US006102395A

United States Patent [19]

Such

[11] Patent Number: 6,102,395

[45] **Date of Patent: *Aug. 15, 2000**

[54] METHOD FOR CONDUCTING A LOTTERY GAME

[75] Inventor: David A. Such, Great Falls, Mont.

[73] Assignee: D. Allan Such & Associates, Inc., Great Falls, Mont.

[ * ] Notice: This patent issued on a continued prosecution application filed under 37 CFR 1.53(d), and is subject to the twenty year patent term provisions of 35 U.S.C. 154(a)(2).

[21] Appl. No.: 09/073,783

[22] Filed: May 6, 1998

Related U.S. Application Data

[63] Continuation of application No. 09/073,783, May 6, 1998.
[60] Provisional application No. 60/045,670, May 6, 1997.

[51] Int. Cl.[7] ..... A63F 3/06
[52] U.S. Cl. ..... 273/139; 273/138.1
[58] Field of Search ..... 273/139, 138.1; 463/17, 18

[56] References Cited

U.S. PATENT DOCUMENTS 5,046,737 9/1991 Fienberg ..... 273/139
5,129,652 7/1992 Wilkinson ..... 273/139

OTHER PUBLICATIONS

ZDI Gaming, Inc., "Progressive PullTab Systems", brochure, 1997 World Gaming Congress & Expo, Oct. 1997.

"Match The Superstar When You Watch Super Bowl XIII", Coca–Cola, 1978.

"1996–1997 Bazaar & Novelty" catalog, Stuart Enterprises, World Congress & Gaming Expo, Las Vegas, Oct. 1995.

*Primary Examiner*—Benjamin H. Layno
*Attorney, Agent, or Firm*—Webb Ziesenheim Logsdon Orkin & Hanson, P.C.

[57] ABSTRACT

In a method for conducting a lottery game having a plurality of ticket sets, a master party sells the ticket sets to organizations. Each organization sells tickets from ticket sets to customers. Each ticket has hidden indicia which, when revealed, may entitile a customer to instant winnings paid by the organization that sold the ticket and/or may entitle the customer to eligibility for a sweepstakes prize. The sweepstakes prize is funded by the master party from proceeds of ticket set sales to organizations.

10 Claims, 1 Drawing Sheet

METHOD FOR CONDUCTING A LOTTERY GAME

RELATED APPLICATION

This application is a continuation of U.S. application Ser. No. 09/073,783 filed May 6, 1998, which claims the benefit of U.S. Provisional Application No. 60/045,670 filed May 6, 1997.

BACKGROUND OF THE INVENTION

This invention is directed to a game of chance kit and, more particularly, to a game kit for use by charitable organizations, clubs, taverns and the like whereby members or customers can purchase a ticket and instantly win a prize if the ticket is a "winner". These kits are sold through licensed distributors in states and provinces where such games are legal. Typically, the kit is purchased by the charitable organization, club or tavern, the tickets are sold and the instant prizes are paid by the kit purchaser. The number of winners is precisely controlled so that the income from ticket sales will exceed the total cost of the instant prizes and so that the ticket purchasers will know in advance the payout if all tickets are purchased.

Game kits have been designed which give the impression of additional levels of play. See, for example, U.S. Pat. No. 5,046,737. However, the additional levels of play permitting the customer to win a bonus or sweepstakes prize requires the bonus or sweepstakes to be funded entirely by the charitable organization, club or tavern selling the sweepstakes winning ticket. Also, it is normally necessary for all tickets in the set to be sold before the winning bonus number can be uncovered on a master game board for the organization to recover its expected return. If the first ticket drawn indicating a right to participate in the sweepstakes matches the hidden number or symbol, it is simply a matter of time and not a matter of chance before the sweepstakes prize is awarded to that ticket holder.

It is an object, according to this invention, to provide a game kit that overcomes the drawbacks described above. It is an advantage, according to this invention, that the sweepstakes prize can be much larger since it is funded by numerous charitable organizations, clubs or taverns, each contributing to the prize at the time of the purchase of the kit. The prize may also be funded by the distributor, the end user or the manufacturer. In this way, the sweepstakes prize can be much grander. The sweepstakes prize can take the form of cash, goods or even a vacation trip, for example. It is a further advantage, according to this invention, that a true additional level of play is provided in that the sweepstakes winner is not predetermined at the time the kits are distributed but only at the time of the sweepstakes drawing.

SUMMARY OF THE INVENTION

Briefly, according to this invention, there is provided a lottery (i.e., game of chance) game kit comprising a container for a set of game tickets of a preselected number which tickets can be obtained by game players. Tickets may be dispensed from the container by hand, or the container may comprise a vending machine. Each ticket has concealed indicia (symbols or numbers), some of which indicate entitlement to an instant prize and/or eligibility for a remote sweepstakes drawing. Each ticket contains indicia of a particular game set and indicia of a master game. A game set comprises all tickets in one container including both winners and losers and tickets indicating eligibility for the sweepstakes drawing. A master game comprises all game sets associated with a single sweepstakes drawing. The lottery game kit further comprises a prize board indicating the correspondence between ticket indicia and instant prizes. The game kit further includes a sweepstakes poster setting forth the sweepstakes prize and instructions for transmitting sweepstakes eligible tickets to the drawing location. Each sweepstakes poster will include the final date for receipt of the name and address of a sweepstakes ticket purchaser and the winning ticket at the drawing location. Finally, the game kit will include one or more mailing envelopes and entry forms for transmitting the name and address of the sweepstakes eligible ticket holders and their winning tickets by certified or registered means. Alternatively, the player could redeem the game piece at a specified drawing location rather than sending it to the drawing location. Preferably, the sweepstakes entry form and ticket will be enclosed in a double envelope so that when the tickets arrive at the drawing location and after the receipt date is confirmed, the outer envelope can be removed and the inner envelope tossed into the hopper from which the winning sweepstakes eligible ticket is drawn while still in the inner envelope. In this way, the drawing cannot be prejudiced by information indicating the source on the outer envelope.

BRIEF DESCRIPTION OF THE DRAWINGS

Further features and other objects and advantages of this invention will be made clear by the following detailed description made with reference to the drawings in which.

DESCRIPTION OF THE PREFERRED EMBODIMENTS

Figure 1A:
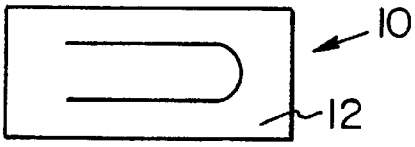
FIGS. 1*a* and 1*b* disclose single game tickets.
Figure 1B:
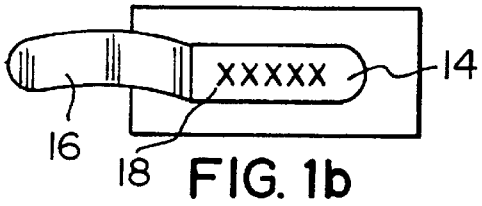
Figure 2:
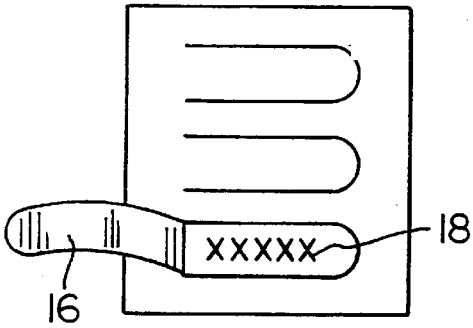
FIG. 2 shows a triple game ticket.

Referring now to FIGS. 1*a* and 1*b*, there are shown tickets 10 which include a laminated upper 12 and lower 14 layer of material such that until torn apart by removing a tab 16, the indicia 18 (symbols or numbers) hidden therein are not visible. Alternately, the ticket may be folded and sealed such that until the seal is broken and the ticket unfolded, the hidden indicia are not visible. The particular ticket illustrated in FIGS. 1*a*, 1*b* and 2 are referred to in the industry as pull-tabs. Other types of tickets, such as scratch-offs, are suitable for use in game kits according to this invention. Game pieces can be dispensed by hand from a container (such as a plastic jar with a screw top) or via a vending machine.

The indicia of the game set and master game on each sweepstakes eligible ticket enables an audit of the drawing to reduce the opportunity for fraudulent entries.

Figure 3:
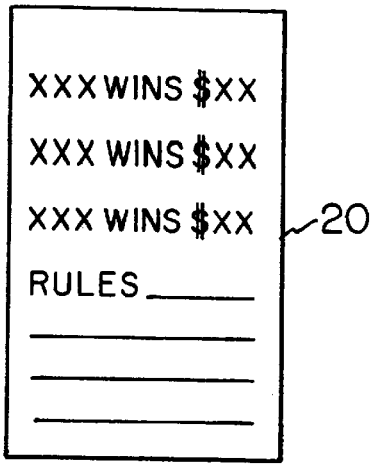
FIG. 3 is a flair or rules board.

Referring to FIG. 3, there is shown a flair or rules board 20 which sets forth the rules and the value of instant winning tickets. The rules board 20 displays a number of winners and the number of total tickets in each game set and any other information required by state laws. The game may be of variable ticket counts.

Figure 4:
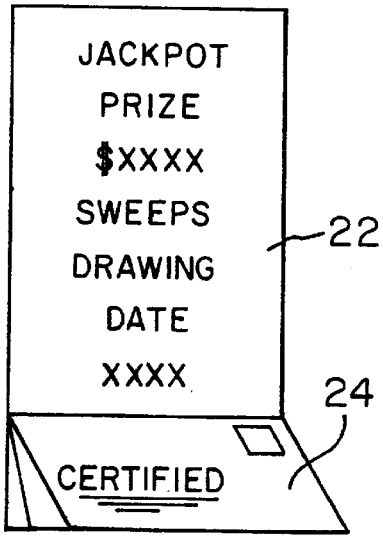
FIG. 4 is a sweepstakes board with attached sweepstakes entry form and envelope kits.

Referring now to FIG. 4, there is displayed a jackpot poster 22 which announces and advertises the jackpot prize, the sweepstakes drawing date and may, for example, include instructions for transmitting sweepstakes eligible tickets to the drawing location. The jackpot poster may also describe the drawing process and procedures for independent verification of the random selection of the winning sweepstakes ticket. The flair 20 and jackpot poster 22 may be combined, if desired.

Also included in the lottery game kit, according to this invention, are means 24 for transmitting the sweepstakes eligible tickets along with the name and address of the purchaser to the drawing location.

Figure 5:
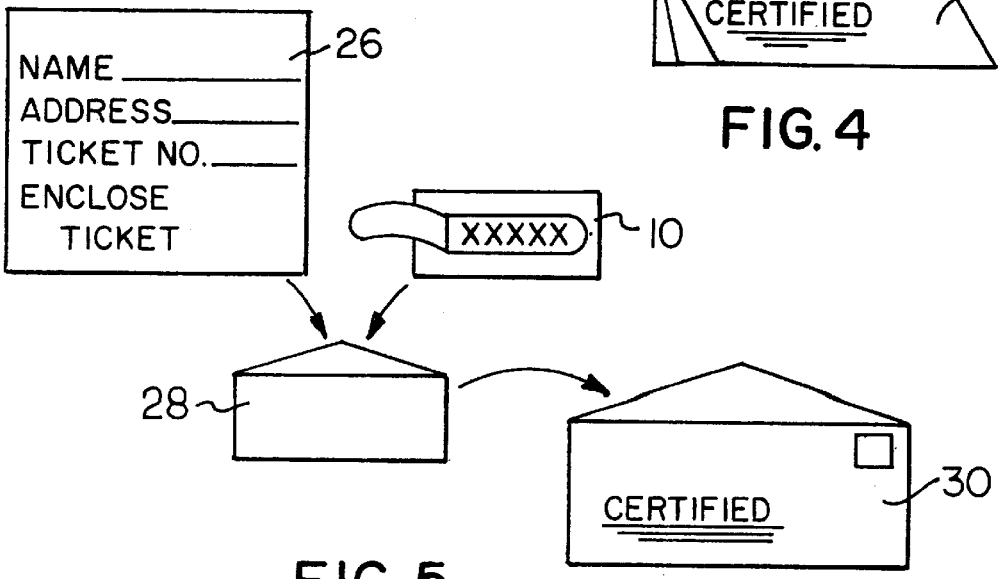
FIG. 5 shows one embodiment of a sweepstakes entry form and envelope kit.

Referring to FIG. 5, according to one embodiment, the means 24 includes an entry form 26 for the entry of the name, address and ticket number of the sweepstakes ticket, an inner envelope 28 which is blank into which the entry form 26 and the sweepstakes ticket 10 can be sealed and an outer envelope 30 designed for certified or registered transmission of the entry form and ticket to the drawing location whereby the purchaser can receive a receipt indicating the date of receipt at the drawing location. Eligible tickets may be returned by mail or delivered in person to the drawing location.

The game tickets may be sold to the end user or they may be given away. The present invention will find many applications, such as charitable gaming, advertisements/promotions, employee incentive programs or simple amusement.

Having thus described my invention with the detail and particularity required by the Patent Laws, what is desired protected by Letters Patent is set forth in the following claim.

I claim:

1. A method for conducting a lottery game having a plurality of ticket sets, wherein each ticket set has a plurality of tickets and wherein each ticket, when opened, reveals hidden indicia, some of which will entitle a customer to instant winnings and/or eligibility for a sweepstakes prize, comprising the steps of:

a) selling, by a master party for proceeds, a ticket set to each of at least two organizations;

b) allowing each organization to issue individual tickets, from the ticket set sold to that organization from the master party, to customers, and allowing each organization to redeem awards for instant winnings on a ticket issued by that organization; and c) retaining by the master party a portion of the proceeds from selling ticket sets to organizations as a pool from which to finance the sweepstakes prize, thereby allowing said master party to exclusively redeem awards for a sweepstakes prize on a ticket issued by an organization by awarding at least a portion of the pool.

2. The method according to claim 1 wherein at least one organization sells, prior to issuing, tickets to customers.

3. The method according to claim 1 further including the step of receiving directly from customers those tickets which make the customers eligible for the sweepstakes prize.

4. The method according to claim 1 further including the step of determining a winner of the sweepstakes prize from the tickets received and providing to the winner an award from the proceedings.

5. The method according to claim 1 further including providing to the organizations a flair explaining the game rules.

6. The method according to claim 5 further including providing to the organizations a poster for displaying the sweepstakes prize and a last date for receipt of sweepstakes tickets at a drawing location.

7. The method according to claim 1 including providing to the organizations means for transmitting the sweepstakes entry to a drawing location.

8. The method according to claim 7 wherein the means for transmitting is comprised of a mailing envelope and an entry form for transmitting the qualifying ticket and the name and address of the customer holding that qualifying ticket.

9. The method according to claim 1 wherein the organization may be any one from a group comprised of a charitable organization, a club and a tavern.

10. The method according to claim 1 wherein the master party may be any one from the group comprised of a distributor, end user or manufacturer.

* * * * *